US007200240B2

(12) United States Patent
Ohara

(10) Patent No.: US 7,200,240 B2
(45) Date of Patent: Apr. 3, 2007

(54) LOUDSPEAKER SPIDER WITH ENHANCED STRUCTURE

(76) Inventor: Hiroshi Ohara, No. 70, Lane 533, Chung-Feng Road, Wu-Lin Village, Lung-Tan Country, Tao-Yuan Hsien (TW)

( * ) Notice: Subject to any disclaimer, the term of this patent is extended or adjusted under 35 U.S.C. 154(b) by 493 days.

(21) Appl. No.: 10/884,279

(22) Filed: Jul. 2, 2004

(65) Prior Publication Data

US 2006/0002580 A1 Jan. 5, 2006

(51) Int. Cl.
*H04R 25/00* (2006.01)

(52) U.S. Cl. ..... 381/404; 381/398; 381/424

(58) Field of Classification Search ..... 381/404, 381/396, 398, 423, 424; 181/144, 155, 202, 181/171, 173, 199
See application file for complete search history.

(56) References Cited

U.S. PATENT DOCUMENTS 2,221,068 A * 11/1940 Alons ..... 381/404
5,850,462 A * 12/1998 Sakamoto et al. ..... 381/405
6,940,991 B2 * 9/2005 Shingu ..... 381/404

* cited by examiner

*Primary Examiner*—Curt Kuntz
*Assistant Examiner*—Tuan Duc Nguyen

(57) ABSTRACT

A spider with an enhanced structure is disclosed. The spider has a plurality of concentric corrugations each of which has a plurality of inflections so that the concentric corrugations have polygonal shapes. With this enhanced structure, a spider can have an improved strength while maintaining an appropriate flexibility. A spider with the enhanced structure can avoid deformations due to un-uniform applications of external forces over a long period of time.

14 Claims, 8 Drawing Sheets

LOUDSPEAKER SPIDER WITH ENHANCED STRUCTURE

FIELD OF THE INVENTION

The present invention relates to a suspension device used in loudspeakers, and more particularly, to a spider used in loudspeakers.

BACKGROUND OF THE INVENTION

As shown in FIG. 1, a typical moving coil loudspeaker consists of a diaphragm, driving devices, and suspension devices. The diaphragm F, when pushed and pulled by the driving devices, vibrates airs and thereby creates sound waves. The diaphragm can have a cone or dome shape. The driving devices include a magnet A, a polar plate B, a top iron C, a gap D, and a voice coil E. The diaphragm is attached to the voice coil. The suspension devices include a surround and a spider G. The surround is a flexible material that attaches the diaphragm's outer rim to the loudspeaker's frame (not shown in FIG. 1). The spider is also a flexible material having a ripple shape. The spider holds the voice coil in position, but allows the voice coil to move freely back and forth.

Running alternating electrical current through the voice coil creates a magnetic field around the voice coil. The magnetic field interacts with the magnet so that the voice coil is attracted or repelled by the magnet. This pushes the voice coil back and forth rapidly, like a piston. When the voice coil moves, it pushes and pulls the attached diaphragm. The diaphragm vibrates airs in front of the loudspeaker and thereby creates sound waves.

The spider functions just like a cushion in an automobile's suspension system. The spider has to be strong enough so that it can sustain the voice coil's vibration without becoming deformed. The spider also has to be flexible enough so that the voice coil can move freely. The two qualities of a spider therefore have significant impacts on the loudspeaker's performance.

FIG. 2 is a stereographic diagram showing a conventional spider G according to a prior art. As shown in FIG. 2, the spider has a plurality of concentric, circular corrugations of crest G1 and trough G2. The spider's center hole is for holding the voice coil (not shown in FIG. 2) while the spider's outer rim is attached to the loudspeaker's frame (not shown in FIG. 2). As shown in FIG. 3A, the spider shows a continuous wave shape in a cross section along a radial direction (along an line A—A of FIG. 2). When the spider is put under external forces, the spider's cross sections perpendicular to the spider's radius as shown in FIG. 3B (along line B—B of FIG. 2) have enough strength. However, the spider's cross sections aligned with the spider's radius as shown in FIG. 3A (along line A—A of FIG. 2) do not have enough strength. Due to mechanical factors or the loudspeaker is not placed on a level location, external forces applied on a spider are not always uniform. After a period of time, the conventional spider may become deformed and thereby its effectiveness for suspending the voice coil is impaired.

SUMMARY OF THE INVENTION

The present invention is directed to obviate a disadvantage of conventional spiders having a plurality of concentric, circular corrugations of crest and trough. The disadvantage is that the spider may become deformed under un-uniform external forces after a long period of time due to a weaker strength resulting from a circular arrangement of corrugations.

In a first embodiment of the present invention, each of a spider's corrugations has a plurality of inflections so that the corrugations are polygonal, instead of circular, corrugations. The spider therefore has a better strength in cross sections along radial directions.

In a second embodiment of the present invention, some of a spider's corrugations have a plurality of inflections so that the corrugations are polygonal, instead of circular, corrugations. The spider therefore has a better strength in cross sections along radial directions.

Characteristics of the present invention are that the inflections are built into a mold for forming the spider so that the spider's corrugations and inflections are formed simultaneously as a whole.

Another characteristics of the present invention are that the inflections are all aligned on straight lines radiated from the spider's center. The spider therefore maintains a fine flexibility while increasing cross-sectional strength along radial directions with inflections.

Compared with conventional spiders with concentric, circular corrugations, the present invention utilizes polygonal corrugations to achieve a better strength while maintaining a necessary flexibility. A spider according to the present invention not only performs better but also has a longer lifetime.

DETAILED DESCRIPTION OF THE PREFERRED EMBODIMENTS

To disclose in details the objectives, characteristics, and features of the present invention, embodiments of the present invention along with the accompanying drawings will be described in the following.

Figure 1:
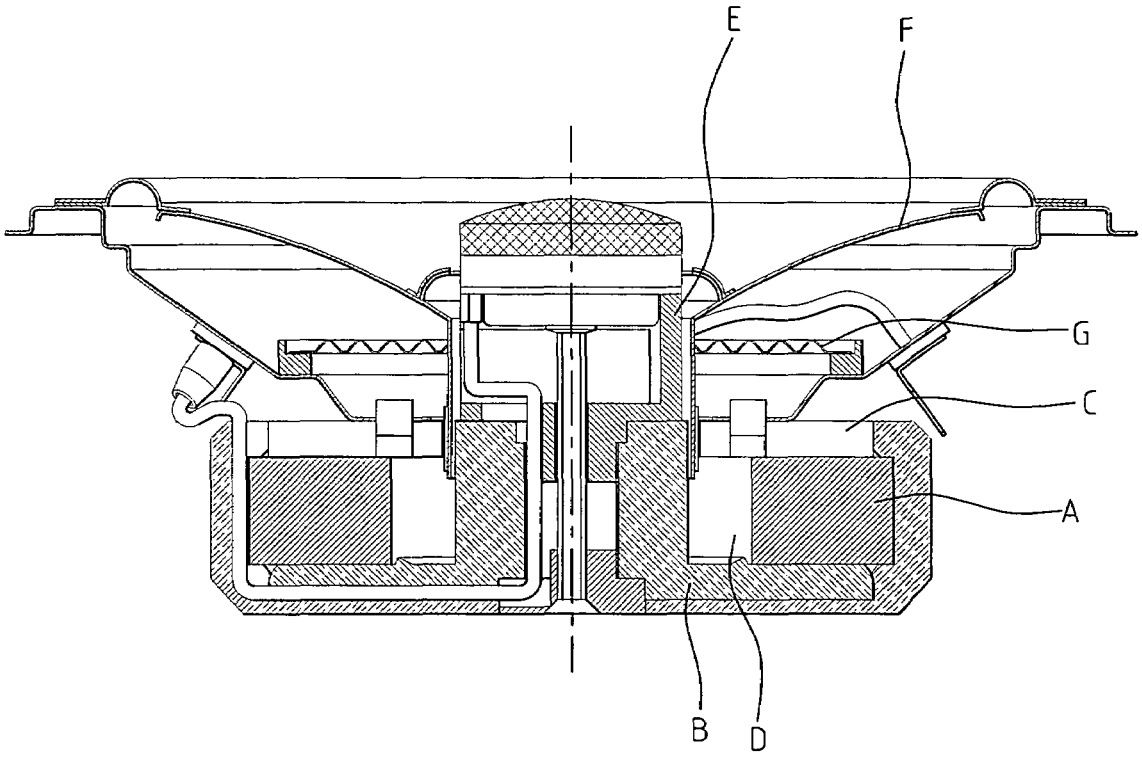
FIG. 1 is a cross-sectional view showing an inside structure of a typical moving coil loudspeaker.
Figure 2:
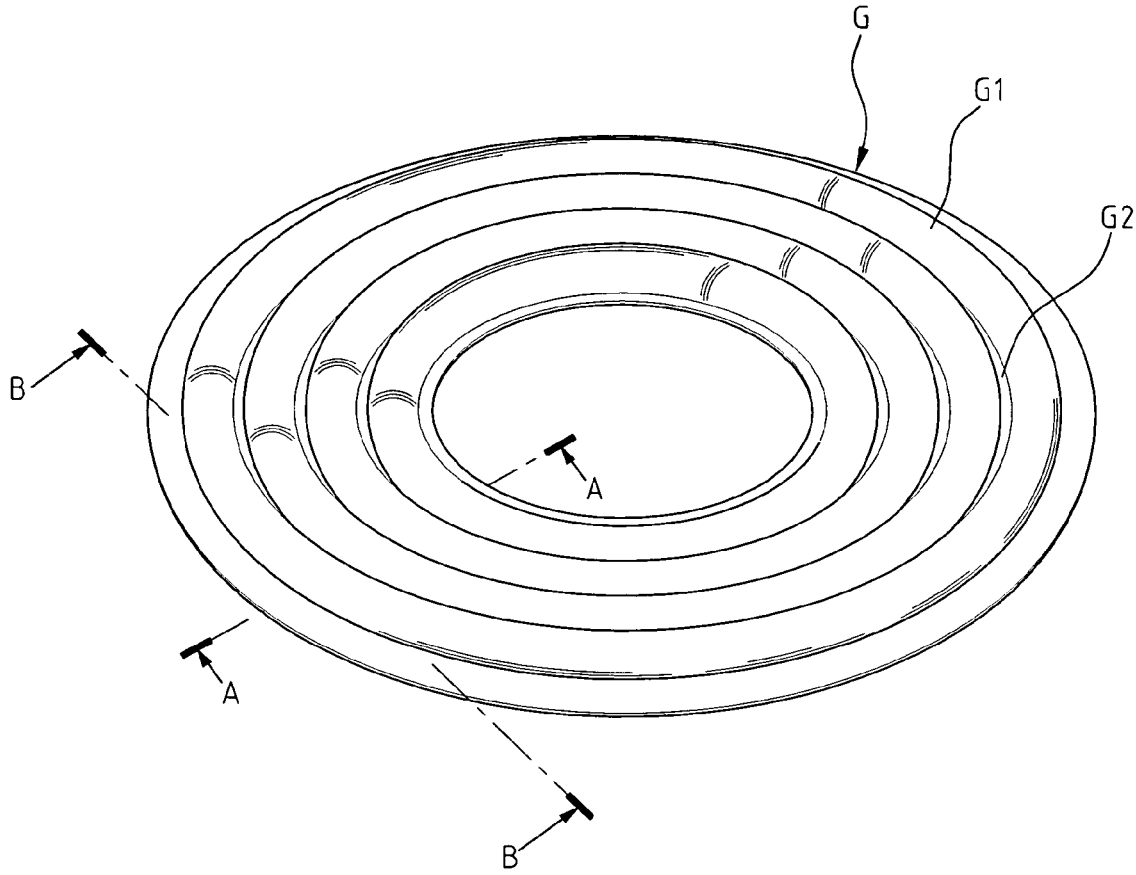
FIG. 2 is a perspective diagram showing a spider according to the prior art.
Figure 3A:
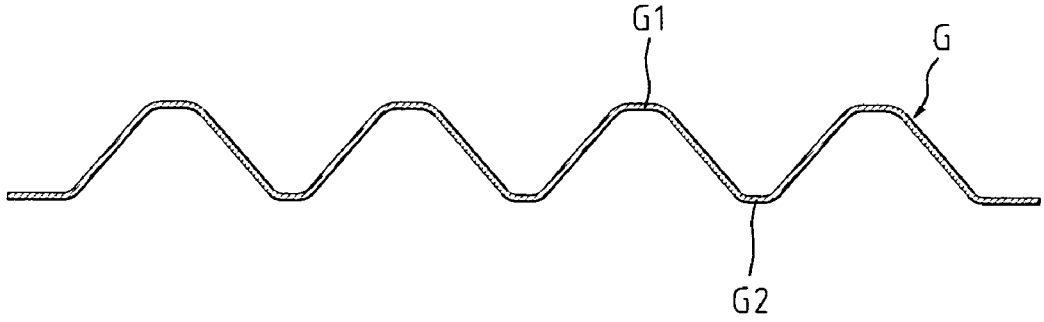
FIG. 3A is a cross-sectional view taken along line A—A of FIG. 2.
Figure 3B:
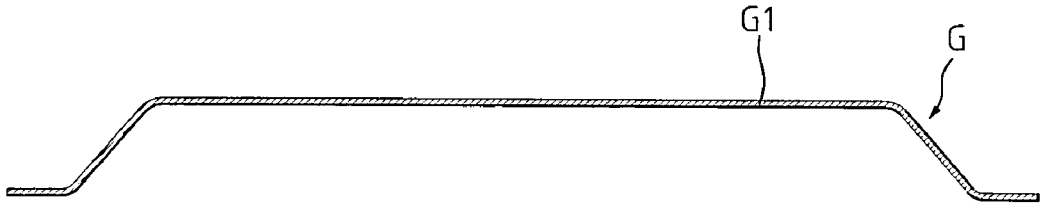
FIG. 3B is a cross-sectional view taken along line B—B of FIG. 2.
Figure 4:
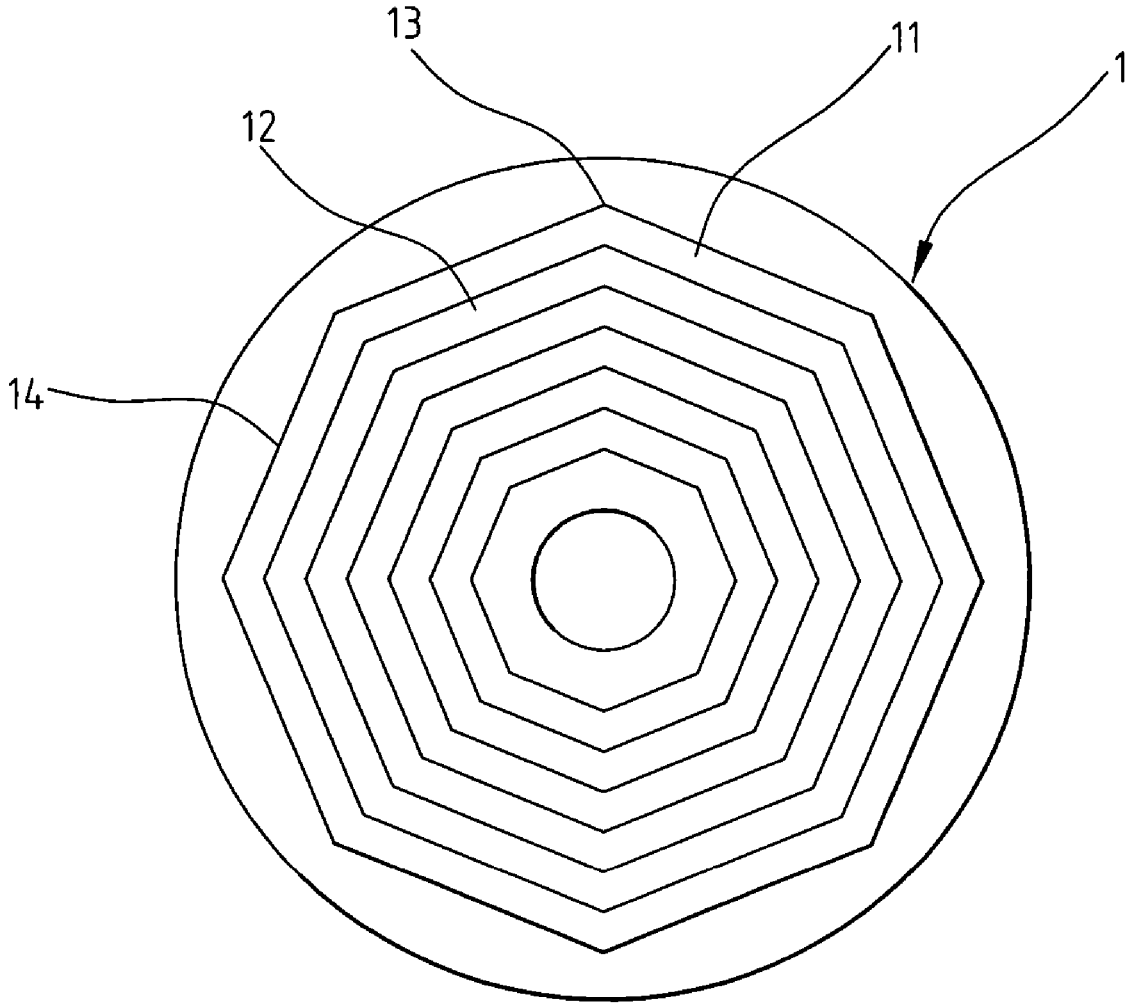
FIG. 4 is a plan view showing a spider according to the present invention whose polygonal corrugations have linear sides.

FIG. 4 illustrates a first embodiment of the present invention. A spider 1 with a plurality of concentric corrugations of crest 11 and trough 12 is formed as a whole by using a molding process. The spider 1 has a continuous wave shape in cross sections along radial directions. Inflections 13 are formed simultaneously with the corrugations 11 and 12 so that the corrugations have polygonal shapes. As the polygonal corrugations consist of a plurality of sides with a shorter length, the spider can have a better strength in cross sections along radial directions.

The spider can be made of cloth or other appropriate material. In a fabrication process of the spider, a piece of cloth is first cut into a circular shape. The piece of round cloth is then put through a molding process. The molding process utilizes a mold consisting of an upper part and a lower part. Both the upper and lower parts of the mold have the polygonal corrugations' upper half and lower half shapes carved into them respectively. The piece of round cloth is then placed between the upper and lower parts of the mold, heated, and compressed tightly by closing the upper and lower parts of the mold toward each other. The piece of round cloth is then molded into a spider with a desired structure and profile.

Figure 5:
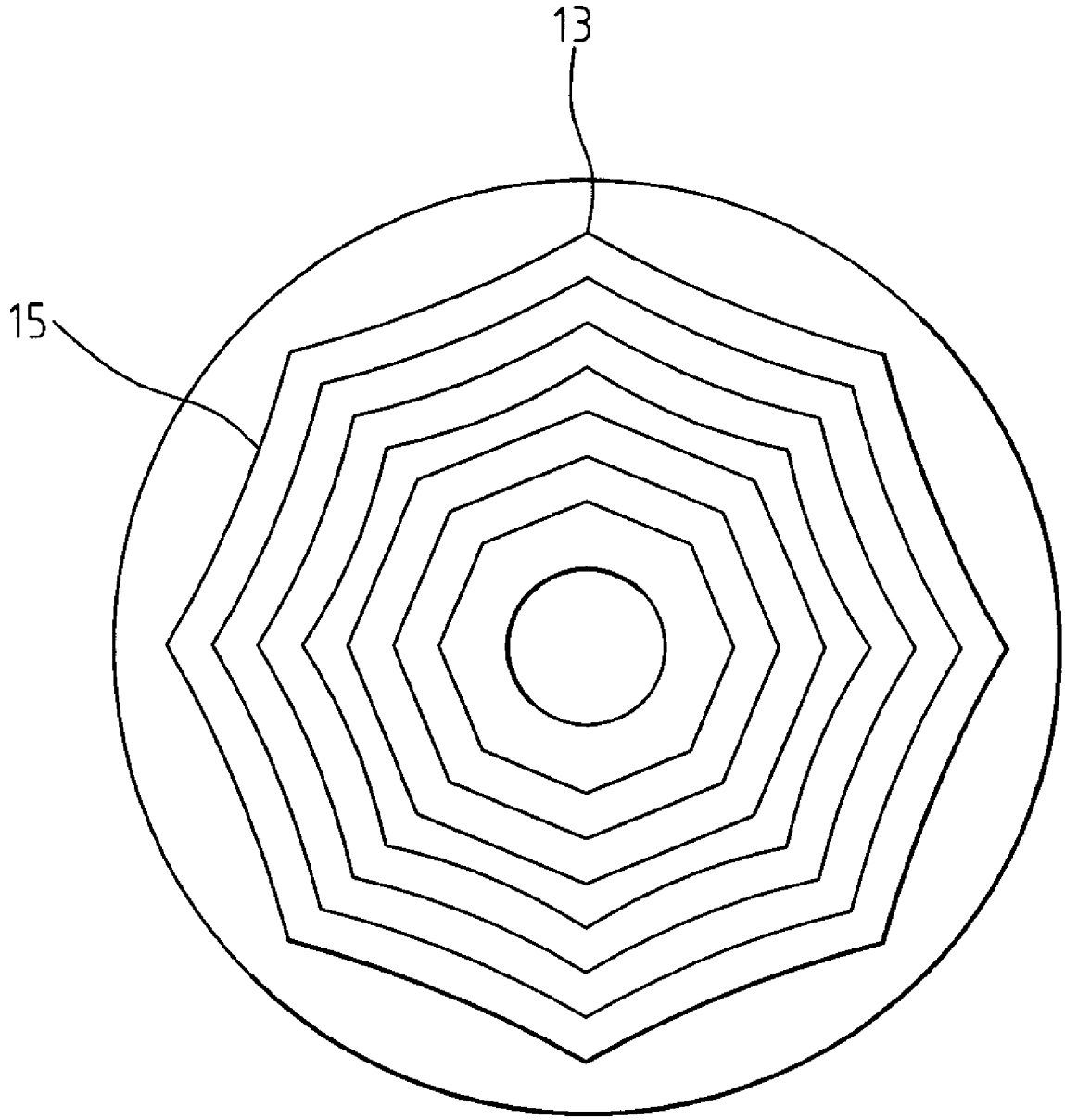
FIG. 5 is a plan view showing a spider according to the present invention whose polygonal corrugations have curved sides and the curved sides cove toward the spider's center with a smaller curvature.
Figure 6:
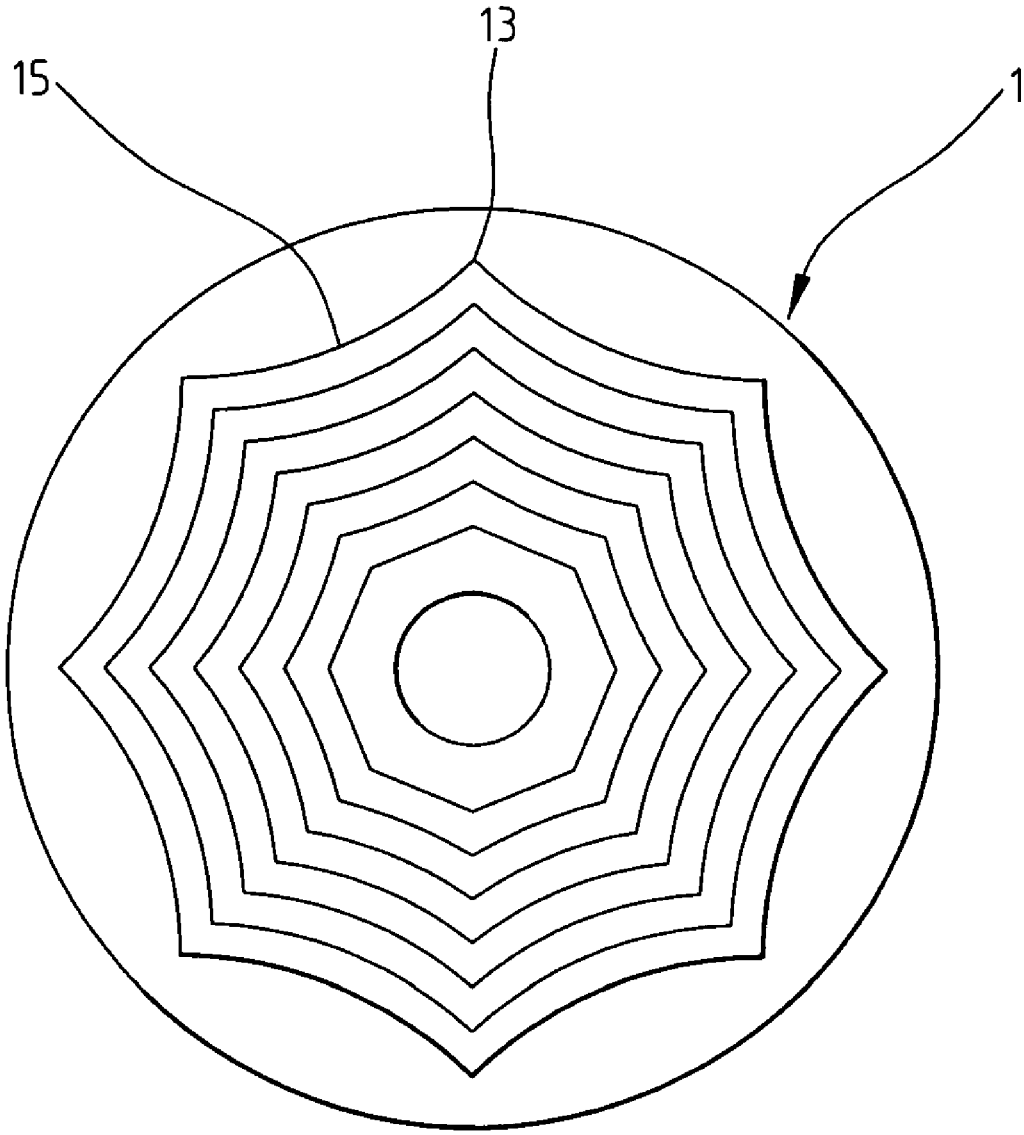
FIG. 6 is a plan view showing a spider according to the present invention whose polygonal corrugations have curved sides and the curved sides cove toward the spider's center with a larger curvature.
Figure 7:
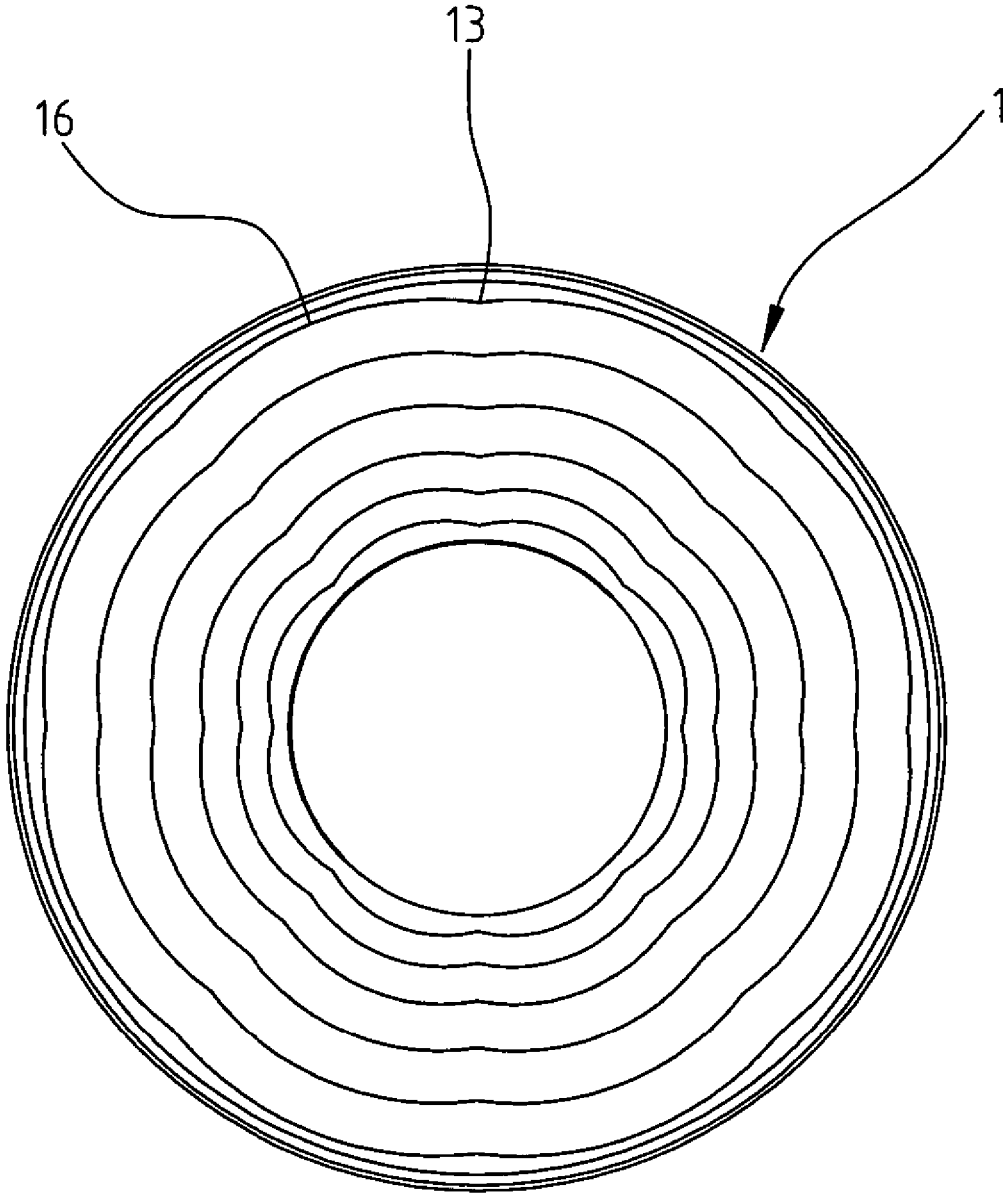
FIG. 7 is a plan view showing a spider according to the present invention whose polygonal corrugations have curved sides and the curved sides bulge outward along radial directions.

As FIG. 4 shows, in the first embodiment of the present invention, the polygonal corrugations of crest 11 and trough 12 have linear sides 14 and inflections 13 are at where the linear sides intersect. A first variation of the first embodiment of the present invention is shown in FIG. 5. The polygonal corrugations have curved sides 15 and the curved sides cove toward the spider's center with a smaller curvature. Inflections 13 are at where the curved sides intersect. A second variation of the first embodiment of the present invention is shown in FIG. 6. The polygonal corrugations have curved sides 15 and the curved sides cove toward the spider's center with a larger curvature. Inflections 13 are at where the curved sides intersect. A third variation of the first embodiment of the present invention is shown in FIG. 7. The polygonal corrugations have curved sides 16 and the curved sides bulge outward along the spider's radial directions. Inflections 13 are at where the curved sides intersect.

Figure 8:
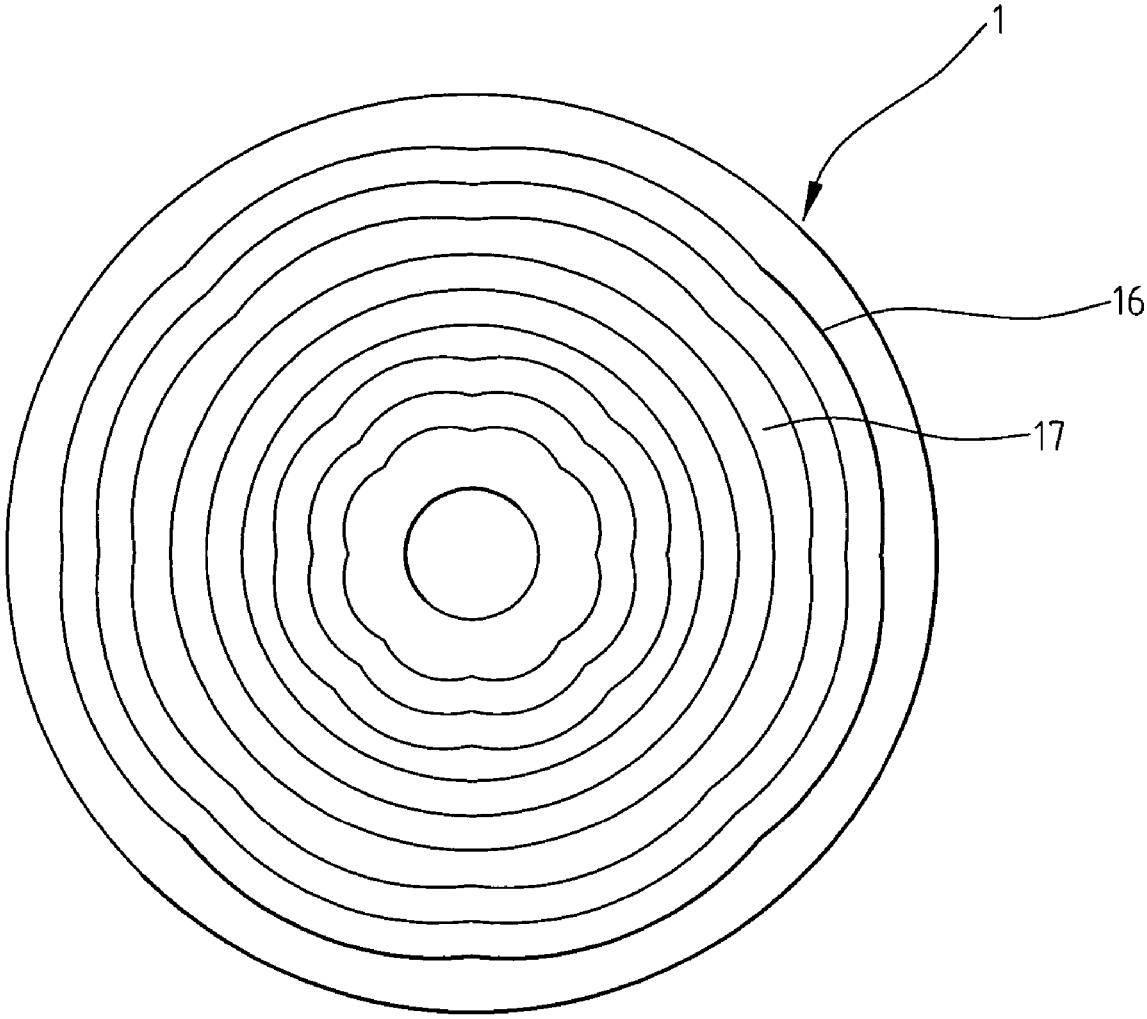
FIG. 8 is a plan view showing a spider according to the present invention, which has interleaved circular and polygonal corrugations.

In another embodiment of the present invention, a spider can have interleaved polygonal and circular corrugations. As shown in FIG. 8, a spider has, sequentially from its center, a plurality of polygonal corrugations with curved sides, and then a plurality of circular corrugations 17, and then a plurality of polygonal corrugations 16 with curved sides, and then a plurality of circular corrugations, and so on. Various kinds of interleaving of polygonal and circular corrugations can be designed and they all can improve a spider's strength.

It will be apparent to those skilled in the art that various modifications and variations can be made to the present invention without departing from the spirit or scope of the invention. Thus, it is intended that the present invention cover the modifications and variations of the present invention provided they come within the scope of the appended claims and their equivalents.

What is claimed is:

1. A spider for a loudspeaker, wherein the spider has a plurality of concentric, polygonal corrugations of crest and trough showing a continuous wave shape in cross sections along radial directions, wherein each of the polygonal corrugations has a plurality of inflections.

2. The spider according to claim 1, wherein the inflections are all aligned on straight lines radiated from the spider's center.

3. The spider according to claim 1, wherein the polygonal corrugations can have linear sides.

4. The spider according to claim 1, wherein the polygonal corrugations can have curved sides.

5. The spider according to claim 4, wherein the curved sides of the polygonal corrugations can cove toward the spider's center.

6. The spider according to claim 4, wherein the curved sides of the polygonal corrugations can bulge outward along radial directions.

7. The spider according to claim 1, wherein the inflections are formed simultaneously along with the corrugations as a whole by using a mold.

8. A spider for a loudspeaker, wherein the spider has a plurality of concentric, polygonal corrugations of crest and trough showing a continuous wave shape in cross sections along radial directions, wherein some of the polygonal corrugations has a plurality of inflections.

9. The spider according to claim 8, wherein the inflections are all aligned on straight lines radiated from the spider's center.

10. The spider according to claim 8, wherein the polygonal corrugations can have linear sides.

11. The spider according to claim 8, wherein the polygonal corrugations can have curved sides.

12. The spider according to claim 11, wherein the curved sides of the polygonal corrugations can cove toward the spider's center.

13. The spider according to claim 11, wherein the curved sides of the polygonal corrugations can bulge outward along radial directions.

14. The spider according to claim 8, wherein the inflections are formed simultaneously along with the corrugations as a whole by using a mold.

* * * * *